US005314657A

United States Patent [19]

Ostlund

[11] Patent Number: 5,314,657

[45] Date of Patent: May 24, 1994

[54] SINTERED CARBONITRIDE ALLOY WITH IMPROVED TOUGHNESS BEHAVIOR AND METHOD OF PRODUCING SAME

[75] Inventor: Ake Ostlund, Taby, Sweden

[73] Assignee: Sandvik AB, Sandviken, Sweden

[21] Appl. No.: 86,132

[22] Filed: Jul. 6, 1993

[30] Foreign Application Priority Data

Jul. 6, 1992 [SE] Sweden ..... 9202090

[51] Int. Cl.[5] ..... C22C 29/04

[52] U.S. Cl. ..... 419/15; 419/14; 419/16; 419/46; 419/13; 75/238; 75/244; 264/DIG. 36; 420/417

[58] Field of Search ..... 419/15, 16, 46, 13; 75/238, 244; 264/DIG. 36; 420/417

[56] References Cited

U.S. PATENT DOCUMENTS

| | | | |
|---|---|---|---|
| 3,971,656 | 7/1976 | Rudy | 75/203 |
| 4,636,252 | 1/1987 | Yoshimura et al. | 75/238 |
| 4,769,070 | 9/1988 | Tobioka et al. | 75/238 |
| 4,935,054 | 6/1990 | Tanabe et al. | 75/501 |
| 4,935,057 | 6/1990 | Yoshimura et al. | 75/238 |

FOREIGN PATENT DOCUMENTS

| | | |
|---|---|---|
| 417333 | 3/1991 | European Pat. Off. . |
| 61-264142 | 11/1986 | Japan . |
| 63-216941 | 9/1988 | Japan . |

*Primary Examiner*—Donald P. Walsh
*Assistant Examiner*—Anthony R. Chi
*Attorney, Agent, or Firm*—Burns, Doane, Swecker & Mathis

[57] ABSTRACT

There is now provided a method of manufacturing a sintered body of titanium-based carbonitride alloy comprising hard constituents in 5–25% binder phase where the hard constituents contain, in addition to Ti, one or more of the metals V, Nb, Ta, Cr, Mo or W and the binder phase is based on cobalt and/or nickel by powder metallurgical methods, i.e., milling, pressing and sintering. The composition of the hard constituents is:

$0.88<a<0.96$;
$0.04<b<0.08$;
$0\leqq c<0.04$;
$0\leqq d<0.04$;
$0.60<f<0.73$;
$0.80<x<0.90$; and
$0.31<h<0.40$.

and the overall composition of the hard constituents phase is expressed by the formula:

$$(Ti_a,Ta_b,Nb_c,V_d)_x(Mo_e,W_f)_y(C_g,N_h)_z.$$

Favorable properties are obtained if the alloy is made from a powder mixture comprising:

23–28% by weight Ti(C,N) with a nitrogen content between 9 and 13% by weight;
13–17% by weight (Ti,Ta)(C,N) with a Ti/Ta ratio of 80/20;
14–18% by weight (Ti,Ta)C with a Ti/Ta ratio of 50/50;
15–20% by weight WC; and
3–7% by weight $Mo_2C$ provided that the total amount of said five powders is >78% by weight and <83% by weight.

8 Claims, No Drawings

SINTERED CARBONITRIDE ALLOY WITH IMPROVED TOUGHNESS BEHAVIOR AND METHOD OF PRODUCING SAME

BACKGROUND OF THE INVENTION

The present invention relates to a sintered carbonitride alloy with titanium as the main component, so-called cermets, intended for milling, drilling and turning of metal, which alloy has a very good toughness behavior in combination with good wear resistance.

Classic titanium-based cutting tool material was based on titanium carbide, molybdenum carbide and nickel. These materials were used for high speed finishing owing to their extraordinary wear resistance at high cutting temperatures. The toughness behavior and resistance against plastic deformation were not satisfactory, however, and so the area of application was rather limited.

Development has proceeded and the range of application for sintered titanium carbonitride based alloys has been considerably enlarged. The toughness behavior and the resistance against plastic deformation for these alloys have been considerably improved.

An important development of titanium-based hard alloys is the substitution of carbon by nitrogen in the hard constituents. This decreases the grain size, usually 1-2 μm, of the hard constituent in the alloy which leads to the possibility of increasing the toughness behavior.

In general, nitrides are more chemically stable than carbides which results in lower tendencies to sticking of workpiece material or wear by dissolution of the tool (so-called diffusional wear).

For the binder phase, the metals of the iron group are used, often Co and Ni in combination. The amount of binder phase is generally 5-25% by weight. Besides titanium, the other metals of the group IVA, VA, VIA are normally used as hard phase formers such as carbides, nitrides and/or carbonitrides. There are also other metals used, for example, Al, which sometimes are said to harden the binder phase and sometimes improve the wetting behavior between hard phase and binder phase.

A very common or even normal microstructure of sintered carbonitride alloy consists of a core-rim structure. For example, U.S. Pat. No. 3,971,656 discloses a sintered carbonitride alloy which comprises Ti- and N-rich cores and rims rich in Mo, W and C. From Swedish patent application no. 8902306-3, it is known that different combinations of duplex core-rim structures in well balanced proportions give improved wear resistance or toughness behavior properties. The distribution of hard constituent particles containing titanium, tantalum and tungsten especially affects the cutting properties for different sintered titanium-based carbonitride alloys with the same overall chemical composition. The difference in cutting behavior remains even when the overall carbon content varies.

From the literature on titanium-based carbonitride alloys, it is apparent that the trend of substituting carbon by nitrogen is very common. It has been shown that properties related to toughness behavior in metal cutting operations (turning, milling and drilling) in general have been improved by substituting titanium carbide by titanium nitride or titanium carbonitride. This holds for a nitrogen content up to a certain level where the wetting properties no longer permit a sintered material without pores. Although diffusional wear (crater wear) resistance is improved with increasing nitrogen content, wear resistance in general decreases with increasing nitrogen content.

The microstructure and the metal cutting properties of sintered titanium-based carbonitrides with the same overall chemical composition vary. For a production process similar to the process generally used in the production of cemented carbides, including pressing and vacuum sintering, different hard constituents behave differently during the liquid phase sintering. Some of the hard constituent particles remain as cores in the sintered carbonitride alloy and inherent more or less completely their metallic composition, while others are completely dissolved and affect the rim structure formation.

U.S. Pat. No. 4,935,057 discloses a method of making a titanium-based carbonitride alloy characterized by the steps of preparing a first powder for forming the core, preparing second powders for forming the rims and preparing a third powder for forming the binder phase. Said powders are milled, compacted and sintered. The first powder is formed of at least one compound selected from the group consisting of TiC, TiCN, (Ti,Ta)C and (Ti,Ta)(C,N).

OBJECTS AND SUMMARY OF THE INVENTION

It is an object of this invention to avoid or alleviate the problems of the prior art.

It is another object of this invention to provide an improved method for forming a titanium-based carbonitride alloy and the resulting product.

In one aspect of the invention there is provided a method of manufacturing a titanium-based carbonitride alloy comprising hard constituents in a binder phase based on a metal taken from the group consisting of cobalt, nickel and mixtures thereof where the composition of the hard constituent phase is represented by the formula with molar indexes:

$$(Ti_a,Ta_b,Nb_c,V_d)_x(Mo_e,W_f)_y(C_g,N_h)_z$$

where:

$0.88<a<0.96$;
$0.04<b<0.08$;
$0\leqq c<0.04$;
$0\leqq d<0.04$;
$0.60<f<0.73$;
$0.80<x<0.90$;
$0.31<h<0.40$;
$a+b+c+d=1$;
$e+f=1$;
$g+h=1$;
$x+y=1$; and
$z<1$.

comprising forming a powder mixture containing the following powders:

23-28% by weight Ti(C,N) with a nitrogen content between 9 and 13% by weight;
13-17% by weight (Ti,Ta)(C,N) with a Ti/Ta ratio of 80/20;
14-18% by weight (Ti,Ta)C with a Ti/Ta ratio of 50/50;
15-20% by weight WC; and
3-7% by weight $Mo_2C$ provided that the total amount of said powders is >78% by weight and <83% by weight and the remaining starting materials are added as TiN, NbC, VC, Co and/or Ni, pressing the powder mixture and sintering the pressed mixture to form said carbonitride alloy.

In another aspect of the invention there is provided the resulting product.

DETAILED DESCRIPTION OF THE PREFERRED EMBODIMENTS OF THE INVENTION

It has now surprisingly been found that it is possible to obtain a titanium-based carbonitride alloy with high nitrogen content, sintered in vacuum with excellent metal cutting toughness behavior and at the same time with a very good wear resistance and reduced porosity. The cutting properties, mainly in milling and drilling but also in turning, have been balanced and the resulting cutting life time has been improved.

These balanced cutting properties for the titanium-based carbonitride alloy according to the invention have been possible to obtain only in a very narrow compositional range in combination with a certain combination of raw materials. It is convenient to represent the composition of the hard constituent phase in titanium-based carbonitride alloys with the formula $$(Ti_a,Ta_b,Nb_c,V_d)_x(Mo_e,W_f)_y(C_g,N_h)_z$$

where the indices a–f are the molar index of respective element of the carbide, carbonitride or nitride formers, and the indices g–h are the molar index of carbon and nitrogen respectively.

The following relations apply: $a+b+c+d=1$, $e+f=1$, $g+h=1$, $x+y=1$ and $z<1$.

The titanium-based sintered alloy according to the present invention is characterized by the following relations:

$0.88<a<0.96$, preferably $0.90<a<0.94$;
$0.04<b<0.08$, preferably $0.05<b<0.07$;
$0\leqq c<0.04$, preferably $0\leqq c<0.03$;
$0\leqq d<0.04$, preferably $0\leqq d<0.03$;
$0.60<f<0.73$, preferably $0.66<f<0.72$;
$0.80<x<0.90$, preferably $0.82<x<0.88$; and
$0.32<h<0.40$, preferably $0.34<h<0.38$.
Oxygen is present as impurity.

The total amount of binder which is Co+Ni is 12–17%, preferably 14–17%, by weight with $0.6<Co/(Co+Ni)<0.7$, preferably $Co/(Co+Ni)=\frac{2}{3}$.

When manufacturing carbonitride alloys, it is possible to obtain very different microstructures after sintering, although the overall chemical composition is kept constant. Usually used terms for the microstructure are hard cores, surrounding structure and binder phase. It is known that the volume fraction of the cores and the surrounding structure varies with the type of raw materials used, when comparing the sintered microstructure for titanium-based carbonitride alloys of the same overall chemical composition. A titanium carbonitride alloy according to the invention is manufactured by mixing powders forming hard cores, surrounding structure and binder phase. Powders are mixed at the same time to a mixture with desired composition. After forming the mixture, a titanium-based carbonitride alloy according to the invention is manufactured by conventional powder metallurgical methods. In order to obtain the favorable properties of an alloy according to the invention the powder mixture has to contain the following in percent of the whole mixture including Co and/or Ni:

23–28% by weight Ti(C,N) with a nitrogen content between 9 and 13% by weight;
13–17% by weight (Ti,Ta)(C,N) with a Ti/Ta ratio of 80/20;
14–18% by weight (Ti,Ta)C with a Ti/Ta ratio of 50/50;
15–20% by weight WC; and
3–7% by weight $Mo_2C$.

The total amount of said powders shall be >78% and <83% by weight.

Remaining starting materials are added as VC, TiN and/or NbC, Co and/or Ni. In the titanium-based alloy according to the invention, the titanium can be replaced by niobium and/or vanadium in an amount not greater than 4 atomic percent.

In a preferred embodiment, the grains of at least one of said Ti-containing powders are rounded, non-angular with a logarithmic normal distribution standard deviation of <0.23 logarithmic μm, most preferably produced by directly carburizing or carbonitriding the metals or their oxides.

From the mixture, bodies are pressed and sintered in vacuum at a pressure of <10 mbar at 1400°–1600° C. The cooling to room temperature takes place in vacuum or inert gas. The bodies may also be formed by hot-pressing or hot isostatic pressing.

The invention is additionally illustrated in connection with the following Examples which are to be considered as illustrative of the present invention. It should be understood, however, that the invention is not limited to the specific details of the Examples.

EXAMPLE 1

From a powder with a composition $a=0.902$, $b=0.059$, $c=0$, $d=0.039$, $f=0.667$, $h=0.384$ and $x=0.862$ with the following mixture of raw materials in percent by weight:

15.6 (Ti,Ta)80/20(C,N)
15.4 (Ti,Ta)50/50C
2.2 TiN
25.6 Ti(C,N) (about 11% N)
1.7 VC
18 WC
4.7 $Mo_2C$
11.2 Co
5.6 Ni, milling inserts SPKN 1203 were pressed and vacuum sintered at 1430° C. for 90 min. The porosity after sintering was <A06. The inserts were ground with a negative chamfer of 10°.

From another powder with exactly the same elemental chemical analysis as the material above but with simple raw materials (TiC, TaC, TiN, Ti(C,N)), milling inserts of the same style were pressed and sintered at 1430° C. for 90 min. The porosity after sintering turned out to be A08 or sometimes >A08.

EXAMPLE 2

SPKN 1203 inserts from the two titanium-based alloys of Example 1 were tested in milling operations. Toughness tests were performed by using single tooth end milling over a rod made of SS2541 with a diameter of 80 mm. The cutter body with a diameter of 250 mm was centrally positioned in relation to the rod. The cutting parameter used was: speed 130 m/min and depth of cut 2.0 mm. The feed corresponding to 50% fracture after testing 30 inserts per variant was 0.21 mm/rev for the variant with simple raw materials and 0.35 for the alloy according to the invention.

EXAMPLE 3

SPKN 1203 inserts from the two titanium-based alloys of Example 1 were tested in milling operations. Wear resistance was tested in steel SS1672 with the following cutting parameters:

Single tooth milling along a rectangular shaped workpiece with a width of 97 mm, depth of cut 2.0 mm, feed 0.12 mm/rev and cutting speed 370 m/min.

The cutter body with a diameter of 125 mm was centrally positioned in relation to the workpiece. The wear results were normalized with the relative value for the variant with simple raw materials set equal to 1.0. The results were:

Flank wear: 1.1
Crater wear: 1.0

When summarizing the results in Examples 1-3, it is obvious that the alloy according to the invention has obtained an improved overall cutting behavior compared to an alloy with the same composition but produced with simple raw materials.

EXAMPLE 4

From a powder with a composition according to the invention a=0.920, b=0.060, c=0.020, d=0, f=0.672, h=0.391 and x=0.861 with the following mixture of raw materials in percent by weight:

15.5 (Ti,Ta)80/20(C,N)
15.5 (Ti,Ta)50/50C
2.2 TiN
26.0 Ti(C,N) (about 11% N)
1.8 NbC
18 WC
4.6 $Mo_2C$
10.9 Co
5.5 Ni, milling inserts SPKN 1203 were pressed and vacuum sintered at 1440° C. for 90 min. The porosity after sintering was <A06. The inserts were ground with a negative chamfer of 10°.

From another powder with exactly the same elemental chemical analysis as the material above but with simple raw materials (TiC, TiN, Ti(C,N), TaC), milling inserts of the same style were pressed and sintered at 1440° C. for 90 min. The porosity after sintering turned out to be >A08.

EXAMPLE 5

SPKN 1203 inserts from the two titanium-based alloys in Example 4 were tested in milling operations. A toughness test was performed in the same way as described in Example 2 and wear resistance tests were performed in the same way as described in Example 3. The feed corresponding to 50% fracture after testing 30 inserts per variant was 0.21 mm/rev for the variant with simple raw materials and 0.37 mm/rev for the alloy according to the invention. The normalized wear results, described in Example 3, were:

Flank wear: 1.1
Crater Wear: 1.1

EXAMPLE 6

From a powder according to the invention with a composition according to Example 4, milling inserts SPKN 1203 were pressed and vacuum sintered at 1440° C. for 90 min.

From another powder with exactly the same elemental chemical composition but with other types of complex raw materials, the tantalum was added as a titanium-tantalum carbonitride with 21 mole % tantalum and a N/(C+N) ratio of 0.67, milling inserts of the same type were pressed and sintered at 1440° C. for 90 min. The milling tests were performed exactly the same as in Examples 2 and 3.

The feed corresponding to 50% fracture after testing 30 inserts per variant was 0.37 mm/rev for the material according to the invention and 0.23 mm/rev for the material with the same chemical composition but with a mixture of complex raw materials outside the invention.

EXAMPLE 7

From the two powder batches described in Example 1 turning inserts CNMG 120408 were pressed and sintered at 1440° C. for 90 min. A turning toughness test was performed on a slotted bar made of SS2244 with the following cutting data:

Speed: 80 m/min
Feed: 0.15 mm/rev
Depth of cut: 2.0 mm

The time corresponding to 50% fracture was 4.0 min for the material according to the invention and 2.5 min for the material with the same chemical analysis but with simple raw materials.

EXAMPLE 8

From a powder A with a composition according to the invention a=0.921, b=0.059, c=0.020, d=0, f=0.670, h=0.390 and x=0.860 with the following mixture of raw materials in percent by weight:

15.3 (Ti,Ta)80/20(C,N)
15.3 (Ti,Ta)50/50C
2.2 TiN
26.2 Ti(C,N) (about 11% N)
1.8 NbC
18 WC
4.7 $Mo_2C$
11.0 Co
5.5 Ni, milling inserts SPKN 1203 were pressed and vacuum sintered at 1440° C. for 90 min. The porosity after sintering was <A06. The inserts were ground with a negative chamfer of 10°.

From another powder B with exactly the same elemental chemical analysis as the material above but made from Ti-containing raw materials with rounded, non-angular grains with a narrow grain size distribution milling inserts of the same style were pressed and sintered. The porosity was A06 or better.

From yet another powder C with exactly the same elemental chemical analysis as the material above but with simple raw materials (TiC, TiN, Ti(C,N), TaC), milling inserts of the same style were pressed and sintered at 1440° C. for 90 min. The porosity after sintering turned out to be >A08.

EXAMPLE 9

The inserts from the three titanium-based alloys in Example 8 were tested in milling operations. A toughness test was performed in the same way as described in Example 2 and wear resistance tests were performed in the same way as described in Example 3. The feed corresponding to 50% fracture after testing 30 inserts per variant was:

| Alloy | Feed, mm/rev |
|---|---|
| A | 0.34 |
| B | 0.46 |
| C | 0.21 |

The normalized wear results, described in Example 3, were:

| | A | B | C |
|---|---|---|---|
| Flank wear: | 1.1 | 1.2 | 1 |
| Crater wear: | 1.1 | 1.1 | 1 |

It can be seen that not only were alloys A and B of the present invention better than the comparison alloy C but also that alloy B containing the rounded, non-angular grains showed improved properties even over alloy A.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method of manufacturing a titanium-based carbonitride alloy comprising hard constituents in a binder phase based on a metal taken from the group consisting of cobalt, nickel and mixtures thereof where the composition of the hard constituent phase is represented by the formula with molar indexes:

$$(Ti_a,Ta_b,Nb_c,V_d)_x(Mo_e,W_f)_y(C_g,N_h)_z$$

where:

$0.88<a<0.96$;
$0.04<b<0.08$;
$0\leqq c<0.04$;
$0\leqq d<0.04$;
$0.60<f<0.73$;
$0.80<x<0.90$;
$0.31<h<0.40$;
$a+b+c+d=1$;
$e+f=1$;
$g+h=1$;
$x+y=1$; and
$0<z<1$;

comprising forming a powder mixture containing the following powders:

23–28% by weight Ti(C,N) with a nitrogen content between 9 and 13% by weight;
13–17% by weight (Ti,Ta)(C,N) with a Ti/Ta ratio of 80/20;
14–18% by weight (Ti,Ta)C with a Ti/Ta ratio of 50/50;
15–20% by weight WC; and
3–7% by weight $Mo_2C$ provided that the total amount of said powders is >78% by weight and <83% by weight and the remaining starting materials are added as TiN, NbC, VC, Co and/or Ni, pressing the powder mixture and sintering the pressed mixture to form the said carbonitride alloy.

2. The method of claim 1, wherein the binder phase content is 12–17% by weight with $0.6<Co/(Co+Ni)<0.7$.

3. The method of claim 1, wherein:

$0.90<a<0.94$;
$0.05<b<0.07$;
$0\leqq c<0.03$;
$0\leqq d<0.03$;
$0.66<f<0.72$;
$0.82<x<0.88$; and
$0.34<h<0.38$.

4. The method of claim 3, wherein the binder is Co+Ni, the binder phase content is 14–17% by weight and $Co/(Co+Ni)=\frac{2}{3}$.

5. The method of claim 1, wherein the grains of at least one of said Ti-containing powders are rounded, non-angular with a logarithmic normal distribution standard deviation of <0.23 logarithmic μm.

6. The method of claim 5, wherein the said Ti-containing powders are produced by directly carburizing or carbonitriding the metals or their oxides.

7. The product of the method of claim 1.

8. The product of the method of claim 5.

* * * * *